United States Patent [19]

Jennie et al.

[11] 3,990,169

[45] Nov. 9, 1976

[54] SAFETY BLOCK FOR GUNS HAVING INTERCHANGEABLE BARRELS

[75] Inventors: Fred L. Jennie, Buena Park; Edmond M. Lishka, Costa Mesa, both of Calif.

[73] Assignee: Weatherby, Inc., South Gate, Calif.

[22] Filed: Aug. 18, 1975

[21] Appl. No.: 605,662

[52] U.S. Cl. ..... 42/1 R; 42/17; 42/70 R; 42/76 R

[51] Int. Cl.[2] ..... F41C 27/00; F41C 17/08; F41C 21/00

[58] Field of Search ..... 42/1 R, 1 N, 1 LP, 76 R, 42/77, 75 B, 17, 70 R

[56] References Cited

UNITED STATES PATENTS 2,476,232 7/1949 Williams ..... 42/17

*Primary Examiner*—Charles T. Jordan

*Attorney, Agent, or Firm*—Herzig & Walsh Inc.

[57] ABSTRACT

A safety device for guns such as gas operated shotguns having interchangeable barrels. The barrels may be chambered for different-sized cartridges or shells, such as 2¾ inch shells or 3 inch shells. It would be unsafe to load a 3 inch shell into a barrel chambered for 2¾ inch shells. The invention is a safety block or lug which is fitted to the barrel chambered for the smaller size cartridge, the block having a position such that it is not possible to load the larger size cartridge into the gun.

4 Claims, 4 Drawing Figures

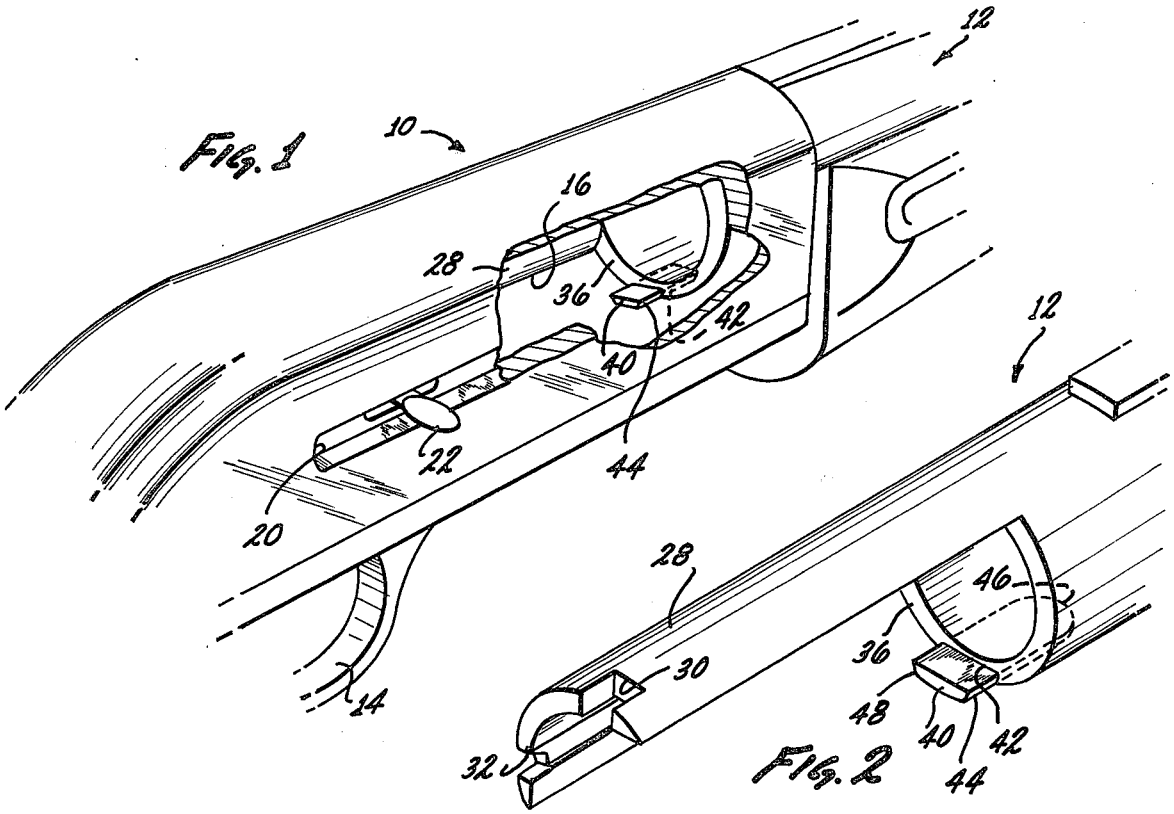
Fig. 1
Fig. 2
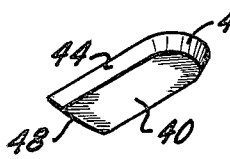
Fig. 3
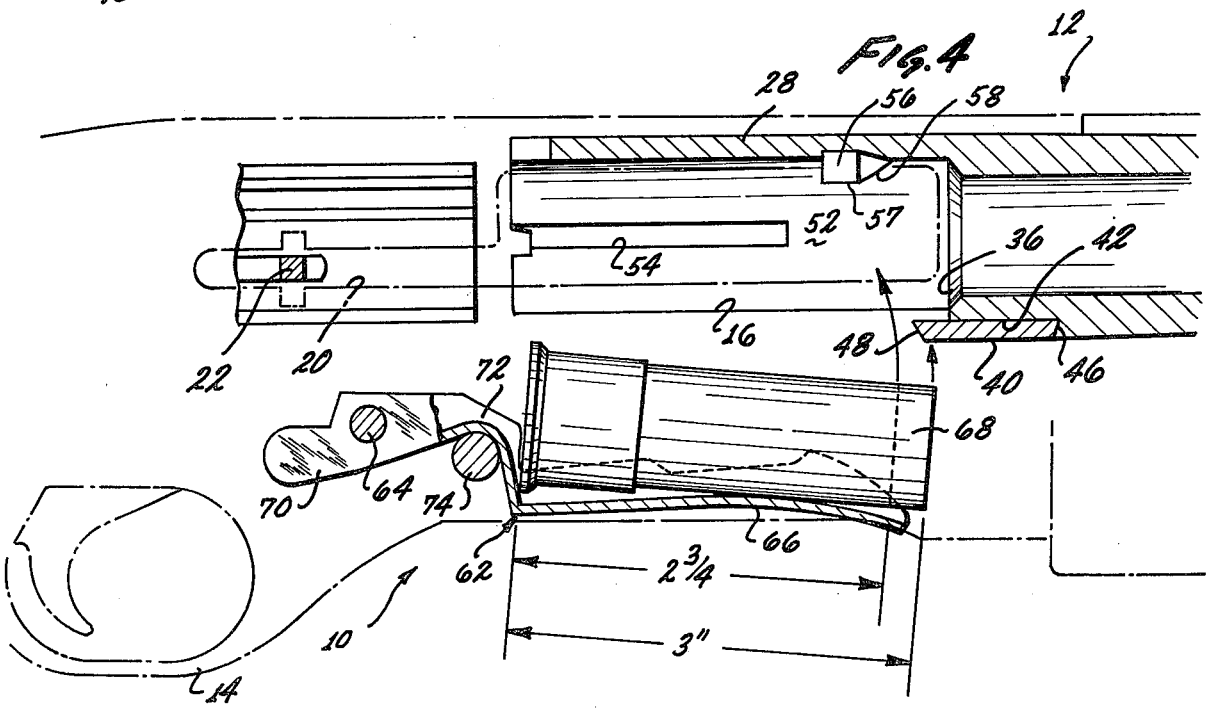
Fig. 4

SAFETY BLOCK FOR GUNS HAVING INTERCHANGEABLE BARRELS

BACKGROUND OF THE INVENTION

1. Field of the Invention

The field of the invention is that of safety devices or accessories for guns, and particularly guns in which the barrels are interchangeable, different barrels being chambered for different sized shells. In the exemplary form of the invention described in detail herein, it is illustrated as adapted to a gas operated, semi-automatic shotgun.

2. Description of the Prior Art

Guns of different types having interchangeable barrels are well known in the art and are conventional. Shotguns quite commonly may be constructed to have interchangeable barrels. Different barrels may be chambered for different loads, that is, different sized cartridges. It is unsafe to load a cartridge that is an oversized cartridge into a barrel not chambered for that size but chambered only for a smaller size. The prior art has not provided anything to offset or eliminate this safety hazard.

SUMMARY OF THE INVENTION

The herein invention provides an extremely simple device and technique for meeting the safety hazard as explained in the foregoing. As pointed out above, the exemplary form of the invention described in detail herein is adapted in a gas operated, semi-automatic shotgun. The invention is adaptable in other types of guns. Typically, in the type of gun referred to, the shells are loaded by being moved upwardly by a shell lifter into alignment with the barrel and then automatically loaded into the chamber at the end of the barrel. In the preferred exemplary form of the invention, it takes the form of a small block, piece or lug which is secured at the lower part of the chamber part of the barrel in a position to extend rearwardly sufficiently so that a shell or cartridge which is oversized cannot be moved upwardly into a position to be loaded. The end of the shell would engage the blocking piece or lug so that loading is prevented.

Having the foregoing in mind, the primary object of the invention is to provide a device or accessory for a gun having the capability of preventing loading of a shell greater than a predetermined size into the barrel.

A further object is to provide a device as in the foregoing in the form of a blocking member positioned at the gun breech and extending therefrom in a position such that a cartridge to be loaded cannot be moved into a position aligned with the barrel for loading.

A further object more specifically, is to provide a blocking piece or lug fitted into a groove or slot at the lower part of the end of the barrel and below the chamber, the lug extending sufficiently so that it would be engaged by the end of an oversized shell being moved upwardly by the shell lifter of the gun.

Further objects and additional advantages of the invention will become apparent from the following detailed description and drawings.

BRIEF DESCRIPTION OF THE DRAWINGS

FIG. 1 is a partial isometric view of the receiver of a gun and the breech part of the barrel illustrating the position of the blocking member of the invention.

FIG. 2 is a partial isometric view of the rear end or breech part of the barrel of the gun showing the blocking piece in position.

FIG. 3 is an isometric view of a preferred form of the blocking piece.

FIG. 4 is an elevational view of the receiver and breech part of the gun of FIG. 1 illustrating the loading mechanism and the function of the blocking piece.

DESCRIPTION OF THE PREFERRED EMBODIMENT

Referring to FIGS. 1 and 4 of the drawings, a part of the firearm is illustrated which may be typical of a semi-automatic gas operated shotgun as referred to in the foregoing. Numeral 10 designates the receiver part of the gun, the gun having a barrel 12. The receiver has a trigger guard 14 and a shell ejection port 16, through which spent shells or cartridges are ejected. In the side of the receiver is a slot 20 and a bolt member 22.

The construction of the receiver and barrel is typical of the type referred to.

Typically, the receiver and barrel may be held in assembled relationship by a foreend nut not shown. At the end of the barrel 12 is an arcuate extension shown at 28 having cutouts 30 and 32 which cooperate with correspondingly configurated parts in the receiver when the barrel and receiver are assembled. Numeral 36 designates the breech end of the barrel, with which the blocking piece or insert of the invention is associated. Numeral 40 designates a preferred form of insert, blocking piece or lug. Formed in the outside of the underpart of the breech end of the barrel 12 is a groove or cutout 42 having bevelled sides shaped to receive in sliding relationship the insert or blocking piece 40. The blocking piece 40 has correspondingly bevelled sides as indicated at 44 in FIG. 3 and the inner end of the insert being arcuate as shown at 46 and the inner end of the groove 42 being of similar configuration. The front end of the insert 40 is also bevelled as shown at 48.

FIG. 4 illustrates schematically how the invention achieves its purpose. In FIG. 4, the loading chamber is identified by a numeral 52. Numeral 54 is a groove which accommodates a shell ejector member. Numeral 56 designates a groove or slot in the upper part of the loading chamber of the receiver, the rear surface 57 of which is flat and the forward surface of which has a taper as designated at 58. Numeral 62 designates the shell lifter member, which is in the form of a lever, pivoted on pivot stem 64. It has a forward part 66 which lifts the shells upwardly into the loading chamber, the shells shown being designated by the numeral 68. The lifter has a rear part 70 which is mounted on the pivot pin or stem 64 with an intermediate part 72 between the forward and rear parts which can cooperate with a stop pin 74. The magazine of the gun typically is below the rear part of the barrel in a position for shells to be moved rearwardly into a position of the lifter 62 as illustrated in FIG. 4. The shell lifter is operated automatically by the mechanism of the gun to move the shell up into the loading chamber and from the loading chamber normally the shell is automatically loaded into the barrel chamber. As may be seen in FIG. 4, the end of the insert or blocking member 40, extends to the rear a sufficient amount such that an oversized shell, as illustrated by the shell 68 in position on the lifter 62 could not be lifted up into the loading chamber because its front end would engage and be blocked by the end of the blocking member 40. In this manner, the blocking member prevents loading into the gun a shell larger than a predetermined size, as determined by the extent of the blocking member. Thus, it is to be seen that in the manner illustrated the device as shown, guns can be fitted so that it is impossible to load shells into the barrel of a size that would be unsafe to be fired in the gun.

From the foregoing, those skilled in the art will readily understand the nature of the invention and the manner in which it achieves and realizes all of the objects as set forth in the foregoing.

The foregoing disclosure is representative of a preferred form of the invention and is to be interpreted in an illustrative rather than a limiting sense, the invention to be accorded the full scope of the claims appended hereto.

What is claimed is:

1. A safety device adapted for utilization in guns of types having interchangeable barrels, different barrels being chambered for different sized shells, the combination comprising a barrel having a breech end part which is normally in a position adjacent to the loading chamber of the gun, and a blocking member positioned at the breech end in a position to block movement of an oversized shell into position for loading into the chamber of the barrel.

2. A device as in claim 1 wherein said blocking member is in the form of a piece of material secured to the lower part of the breech end of the barrel and extending rearwardly therefrom a predetermined amount.

3. A device as in claim 2 wherein the lower part of the breech end of the barrel is provided with a slot forming a way, the said blocking piece being shaped to interfit and be held by the said slot.

4. A device as in claim 3 wherein the said slot has bevelled sides and the blocking piece has correspondingly bevelled sides.

* * * * *